United States Patent [19]

Fernbacher et al.

[11] Patent Number: 4,683,947

[45] Date of Patent: Aug. 4, 1987

[54] PROCESS AND APPARATUS FOR MONITORING AND CONTROLLING THE FLAMMABILITY OF GAS FROM AN IN-SITU COMBUSTION OIL RECOVERY PROJECT

[75] Inventors: John M. Fernbacher, Allentown; James G. Hansel, Emmaus, both of Pa.

[73] Assignee: Air Products and Chemicals Inc., Allentown, Pa.

[21] Appl. No.: 772,968

[22] Filed: Sep. 5, 1985

[51] Int. Cl.[4] ..... E21B 43/24; E21B 43/243

[52] U.S. Cl. ..... 166/251; 166/250; 166/256; 166/261

[58] Field of Search ..... 166/250, 251, 256, 261, 166/264, 266, 303

[56] References Cited

U.S. PATENT DOCUMENTS

| | | | |
|---|---|---|---|
| 3,032,102 | 5/1962 | Parker | 166/251 |
| 3,470,954 | 10/1969 | Hartley | 166/251 |
| 3,892,270 | 7/1975 | Lindquist | 166/261 X |
| 4,120,354 | 10/1978 | Ridley et al. | 166/251 |
| 4,344,484 | 8/1982 | Ridley | 166/251 |
| 4,369,841 | 1/1983 | Cha | 166/251 |
| 4,369,842 | 1/1983 | Cha | 166/251 |
| 4,501,325 | 2/1985 | Frazier et al. | 166/265 X |

OTHER PUBLICATIONS

Limits of Flammability of Gases and Vapors, Bulletin 503, Bureau of Mines, by H. F. Coward and G. W. Jones, 1952, pp. 32, 43, and 56.

Introduction to Chemical Engineering Thermodynamics, McGraw-Hill Book Co., by J. M. Smith and H. C. Van Ness, 1949, pp. 296-302.

*Primary Examiner*—Stephen J. Novosad
*Assistant Examiner*—Thomas J. Odar
*Attorney, Agent, or Firm*—Geoffrey L. Chase; E. Eugene Innis; James C. Simmons

[57] ABSTRACT

Process and apparatus are set forth for ascertaining and controlling the flammability of produced gas from an in-situ combustion enhanced petroleum production well whereby the produced oil is sampled, the produced gas is periodically sampled, the temperature, pressure and produced gas flow rate are sensed, and a moderant gas is added to the production well to avoid flammability when the sampled and sensed parameters indicate a flammability condition exists.

4 Claims, 2 Drawing Figures

PROCESS AND APPARATUS FOR MONITORING AND CONTROLLING THE FLAMMABILITY OF GAS FROM AN IN-SITU COMBUSTION OIL RECOVERY PROJECT

TECHNICAL FIELD

The present invention is directed to detecting flammability conditions of produced gases from a petroleum production well. More specifically, the present invention is directed to a process and apparatus for controllably adding a moderant gas to a production well based upon monitored parameters of flammability in the produced gas to effect a reduction in any actual or potential flammability or detonation potential of the produced gas.

BACKGROUND OF THE INVENTION

With the increased costs of petroleum resources, the diminishing known reserves of petroleum, as well as the increased costs of exploring for new petroleum reserves, the petroleum production and refining industry has utilized enhanced recovery techniques to produce petroleum and gas from non-naturally producing reserves and from formerly naturally producing reserves which have been partially or substantially depleted. Enhanced recovery techniques include a wide range of manipulations to recover petroleum and gas from petroleum bearing geologic formations, including miscible gas pressurization, selective liquid flooding and in-situ combustion or fireflooding.

Commercial in-situ combustion projects involves the placement of one or more of injection wells in the vicinity of a single or plurality of production wells. Air, oxygen enriched air or potentially pure oxygen is introduced into the petroleum bearing formation through an injection well and either spontaneously combusts a portion of the petroleum reserve or supports combustion induced by other means. The in-situ oxygen-fed combustion typically moves in a wave front through the petroleum bearing formation from the injection well to the production well. Occasionally, the oxygen gas introduced into the injection well comprising air, oxygen enriched air or oxygen, breaks through the wave front or otherwise bypasses the wavefront and appears as uncombusted gas in the production well produced gas. Additionally, the combustion may form substantial quantities of carbon monoxide which are co-produced with the hydrocarbon gases normally produced in association with petroleum production. The presence of an oxygen-containing gas, carbon monoxide, hydrocarbon gases and vapors, as well as possible hydrogen and hydrogen sulfide in the production well presents a potential problem for flammability or detonation.

Techniques for flammability and detonation detection and control for in-situ combustion projects have not been practiced in the prior art. Operators of in-situ combustion petroleum recovery projects have either been unaware of the potential production well flammability and detonation hazard, have chosen to operate the project regardless of the hazardous condition or have merely shut the wells in and closed them down. Those in-situ combustion wells that have presented serious combustion problems, or in fact, have undergone combustion or detonation have merely been shut in and closed off by known methods, such that the well is no longer useful for the production of petroleum. The petroleum production industry has previously felt that work in petroleum fields with flammable or detonable produced gas mixtures is an assumed risk which has not warranted monitoring and control techniques.

The present invention overcomes the safety drawbacks of the prior art practice of in-situ combustion petroleum recovery as set forth below.

BRIEF SUMMARY OF THE INVENTION

The present invention constitutes a process for producing oil and gas from a production well and oil-bearing formation using in-situ combustion of a portion of the oil with an oxidant gas, the improvement for controlling the flammability of the gas co-produced with the oil, comprising: sampling the produced oil from said production well and determining its distillation characteristics, periodically sampling the produced gas from said production well, sensing the temperature and pressure of the production well and sensing the flow rate of the produced gas, processing the sampled production gas through a gas analyzer to determine its gas composition, comparing the output of the gas analysis adjusted for the conditions of the distillation characteristics of the produced oil, the temperature and pressure at the bottom of the production well and gas flow rate against pre-existing gas composition specifications for flammability, and injecting a moderant gas into the production well adjacent the oil bearing formation when the composition of the analyzed gas exceeds the pre-existing gas composition specifications for flammability, said injection continuing until the sampled production gas is outside the range of gas composition specifications for such flammability.

Preferably, moderant gas is selected from the group consisting of nitrogen, carbon dioxide, argon, steam, air, a fuel gas such as methane or a relatively inert combustion product gas.

The present invention is also directed to an apparatus for producing oil and gas from the production well in an oil-bearing formation using an in-situ combustion of a portion of the oil with an oxidant gas, the improvement for controlling the flammability of the gas co-produced with the oil, comprising: means for sampling the produced oil from said production well and determining its distillation characteristics, means for sampling the produced gas from said production well, temperature and pressure sensing means associated with the production well and a flow rate sensing means for determining the flow of produced gas, a gas analyzer for determining the composition of the sampled gas, means for introducing a moderant gas into the production well adjacent the oil bearing formation including a tubular or pipe string and operatively associated valve for injecting said moderant gas, computation means for receiving the output of the oil sampling means, the gas analyzer, the temperature and pressure sensing means and the flow rate sensing means and comparing those values against pre-existing gas composition specifications for flammability, and, means for opening said valve responsive to a signal from the computation means when the computed value exceeds the pre-existing gas composition specifications for flammability.

DETAILED DESCRIPTION OF THE INVENTION

Figure 1:
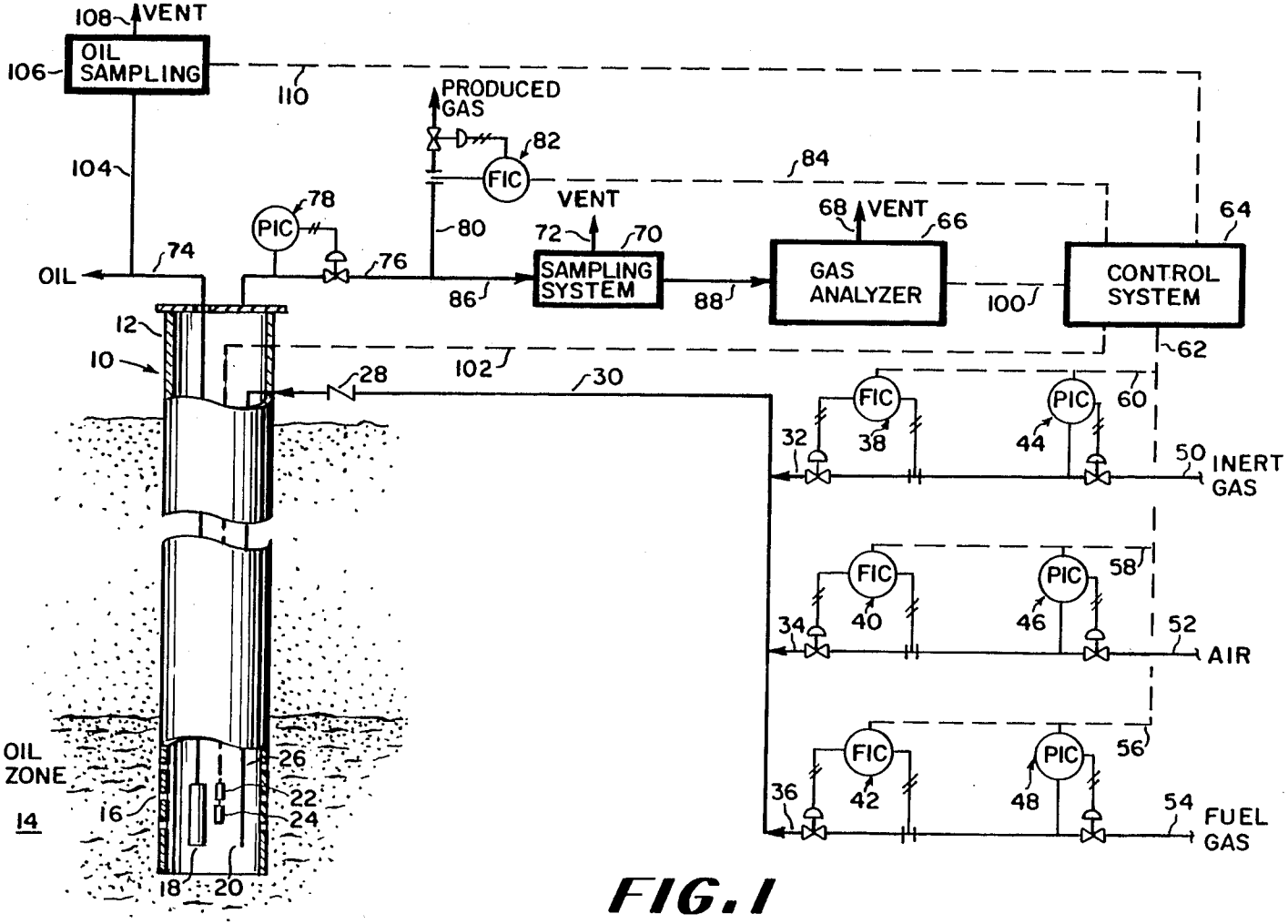
FIG. 1 is a schematic flowscheme incorporating a cross section of a production well showing the arrangement of the monitoring and control system of the present invention.

The present invention, comprising a process and apparatus for monitoring the co-produced gas of a petroleum in-situ combustion production well, provides a degree of control and safety over flammability and detonation conditions in such a well which is in marked contrast to the lack of monitoring and control practiced in the prior art. Typically, in an in-situ combustion enhanced recovery petroleum project, the production well is placed into a petroleum bearing formation, and the petroleum, if not naturally pressurized, is pumped from the petroleum bearing formation. Natural production by reservoir pressure usually does not produce significant quantites of oil in in-situ combustion eligible projects. It is therefore necessary to pump the petroleum from the production well. Pumping of such reservoirs may produce only limited quantities of oil economically. Water flooding may be the next production procedure to yield additional oil. Finally an enhanced production method, such as in-situ combustion, may be applied to the reservoir. Various hydrocarbon gases and vapors, as well as water vapor, are produced in association with the petroleum. These gases typically comprise lower and intermediate hydrocarbons, carbon monoxide and occasionally other fuel components, such as hydrogen or hydrogen sulfide with nitrogen and carbon dioxide. The nitrogen is present usually with air assisted combustion. When pure oxygen is used, the nitrogen content will be negligible. The nitrogen and carbon dioxide are inert and, therefore, can render a nonflammable co-produced gas product, if sufficient amounts are present. When in-situ combustion is utilized, the potential exists for air, oxygen, carbon monoxide and hydrocarbons to appear with the above gases. The air, oxygen, carbon monoxide and hydrocarbons render the associated co-produced gas flammable or detonable, depending upon the exact compositional range of these gaseous and vapor components.

The present invention utilizes a system of periodic repetitious sampling of the co-produced gas wherein the samples are passed through a gas analyzer, preferably including a gas chromatograph, to ascertain the exact composition of the sampled gas. The analyzed gas composition is then fed to a digital computer as an input to an automatically calculated computation or comparison of the sample composition and pre-existing programmed data on compositions and flammability already existing in the digital computer. Alternatively, the analyzed gas composition may be manually checked by an operator against pre-existing flammability specifications to determine flammability and detonation potential. To correctly and accurately ascertain safe versus unsafe gas production in in-situ combustion projects, it is also necessary to consider other parameters aside from gas composition. The temperature and pressure of the production well is also important in determining flammability conditions in the production well. The present invention provides input of such down hole temperature and pressure conditions or conditions representative of down hole conditions into the control system taking the form of a digital computer. Again, alternatively, a manual operator could observe temperature and pressure sensitive equipment to make the appropriate computation and comparison for flammability detection. Alternatively, the temperature of the produced oil can be detected, which temperature is approximately the same as down hole temperatures. Pressure at the well head is within several psi of the down hole pressure condition, dependent on the length of the well. Therefore, pressure can be sensed at the well head, rather than at the bottom of the well, to provide an accurate indication of down hole pressure.

The distillation boiling range or distribution of the petroleum being co-produced with the gas is also important to determining flammability and detonation potential of the co-produced gas. Therefore, the present invention provides means for sampling the produced petroleum and subjecting it to a distillation determination wherein this data is also introduced into the digital computer as pre-existing data to compare flammability and detonation potential.

Having ascertained that a flammability or detonation potential exists in a production well, the present invention provides a unique solution, that unlike the prior art allows the production well to continue operation under non-flammable or non-detonable conditions. The control system in the form of a digital computer signals for the addition of a moderant gas to the production well in the area of the petroleum bearing formation at a rate relative to the production rate for the associated gas which is also input to the control system. The addition of a moderant gas changes the overall produced gas composition and prevents it from becoming flammable and detonable, or if already flammable and detonable, renders it outside the flammable and detonable range. By continually monitoring the produced gas from the production well, the results of the moderant gas addition will be detected, and shut-down of the moderant gas supply will occur when a non-flammable or non-detonable condition of the produced gas is achieved.

Various moderant gases may be utilized in the practice of the present invention. Although it would appear that an inert gas would be required to affect the present invention, it has been ascertained by the present inventors that air, despite its oxygen content, and fuel gas, despite its fuel content, may also be utilized as the moderant gas added to the production well under certain circumstances. The availability of these choices provides an operator with increased flexibility in practicing the present invention. For instance, appropriate moderant gases may include nitrogen, carbon dioxide, argon or the essentially inert combustion products of a site oriented combustion process. Such species of moderant gases will be referred to herein as an inert gas expressed in terms of its nitrogen equivalent. Equivalency is determined by calculations for comparable specific heat as set forth hereinbelow. However, in the event that such gases are not readily available at the site, the present invention, under certain conditions, allows the use of air or fuel gas for the moderant gas injection procedure of the present invention. Under certain circumstances, fuel gas or air may be an inappropriate medium for controlling flammability and detonation potential.

With reference to FIG. 1, the operation of the present invention will be set forth in schematic format. A production well 10 is typically placed into a geologic formation so as to intersect a petroleum or oil zone 14. The production well comprises an outer casing 12 with various tubulars or pipes 74 placed in the longitudinal or vertical interior of the production well. The casing 12 may be continuous or intermittent. Perforations 16 exist in the lower portion of the casing 12 which allow oil, natural gas and associated other gases to move from the petroleum bearing formation 14 into the production well. In the case of non-naturally producing petroleum reserves, the petroleum is removed by pump 18, attached to a tubular 74. This oil can then be refined for appropriate end uses. The oil may contain associated water. The associated co-produced gases rise through the production well 12 and are removed in a pipe 76 which may be subject to pressure controlled valve assembly 78. (In this text, valve assembly includes a valve and an indicator control with appropriate lines communicating therebetween). The produced gas is removed in line 80 and may be subject to flow control valve assembly 82.

In-situ combustion projects inject an oxidant gas in an injection well, not shown, and such gas burns a portion of the oil in the oil bearing formation. The combustion wave front slowly approaches the production well, pushing higher temperature oil and associated gas towards the production well for production. Therefore, carbon monoxide, oxygen, nitrogen, carbon dioxide, hydrocarbons, hydrogen, hydrogen sulfide, associated gases and/or air are potential composition species that may be present in the co-produced gas of the production well. The present invention periodically samples the produced gas by removing a slipstream in line 86 by means of a sampling system 70. The sampling system can comprise any means of selecting a fixed volume which allows an aliquot of gas to be injected through line 88 into a gas analyzer 66. At least a portion of the gas in line 86 may be vented in line 72 when not directed to the gas analyzer 66. The gas analyzer may most appropriately include a gas chromatograph and optionally an oxygen analyzer, a filter device and a hydrocarbon detector. Expended gas is vented in line 68 while data on the composition of the sampled gas stream is delivered from the gas chromatograph or gas analyzer 66 by circuit 100 to a control system 64, preferably a digital computer. The data is sent in digital coded electronic signals, preferably.

Preferably, temperature 22 and pressure 24 sensing equipment is also placed in or on the production well 10. Alternatively, the temperature of the produced oil can be sensed line 74, and pressure can be sensed at the well head of the casing. The output of these sensors is delivered through circuit 102 to the control system 64. Additional input is provided through the flow control valve assembly 82 which inputs its data through circuit 84 to the control system 64. Finally, the type of petroleum being produced is sampled from line 74 in line 104 by appropriate oil or petroleum sampling equipment 106 wherein the distillation or boiling point distribution of the petroleum is ascertained. Although water vapor is produced with the gas and water can be produced with the oil, the water vapor content is sufficiently low, such that under most circumstances consideration of that water content is not necessary for flammability considerations. Data developed from this analysis is input to the control system 64 through circuit 110. The distilled petroleum sample may be vented in line 108. Alternatively, the distillation analysis can be carried out elsewhere and the data input directly to the control system 64.

Based upon the gas composition of the produced gas provided in circuit 100 and adjusted for the conditions of temperature and pressure input through circuit 102 and the type of petroleum produced which data is input in circuit 110, the control system 64, in the form preferably of a digital computer, periodically compares this data against pre-existing data for flammability and detonation specifications previously programmed into the computer. When the sampled gas composition adjusted for the other parameters is near or within the flammability and detonation range, the control system 64 provides a signal of relative magnitude adjusted for the flow of produced gas as sensed in assembly 82 and input in circuit 84 to open appropriate valves in one of three selected moderant sources 50, 52 or 54 by means of a signal in circuit 62.

Although it is possible to operate the present invention with a selection of the three species of moderant gases, namely; inert gas, air and oxygen-containing gases or fuel gas, it is also entirely appropriate to operate the invention with only one available species of gas, preferably an inert gas. The control system 64 controls pressure and flow valves in the moderant gas supply to provide sufficient moderant through line 30 and check valve 28 through tubular 26 and pipe end 20 in the vicinity of the base of the production well, where the initial flammability and detonation potential exists. By constantly or periodically sampling the analyzing the produced gas and comparing it to known flammability data, the effect of the moderant addition can be monitored, and continuous processing may be effected. Preferably, the control system operates in a feedback control manner, where the rate of moderant necessary for continuous operation is sensed and injected so as to avoid sequential on-off injection conditions and economize on the moderant use.

The moderant gas in line 30 can be added to the production well 10 in a similar manner from any one of the three species from lines 50, 52 or 54. For instance, an inert gas, such as nitrogen supplied in line 50, is controllably introduced through a pressure valve assembly 44 and/or a flow valve assembly 38 in line 32 subject to input control from the control system 64 through circuit 62 and circuit 60. Similarly, the addition of air in line 52 can be controllably performed by pressure control valve assembly 46 and/or flow control valve assembly 40 in line 34 by appropriate signal input through circuit 62 and circuit 58. Lastly, fuel gas addition in line 54 may be controllably added by operation of pressure controlled valve assembly 48 and/or flow control valve assembly 42 in line 36 by signal input through circuit 62 and circuit 56. Alternatively, the ascertainment of gas composition and sensing of conditions may be performed by an operator and appropriate control of moderant supply may be manually performed to affect the monitoring and control of flammability and detonation potential in the production well along the lines of the process and apparatus of the present invention. However, preferably the present invention is operated in an automatic technique with an appropriately programmed digital computer.

Figure 2:
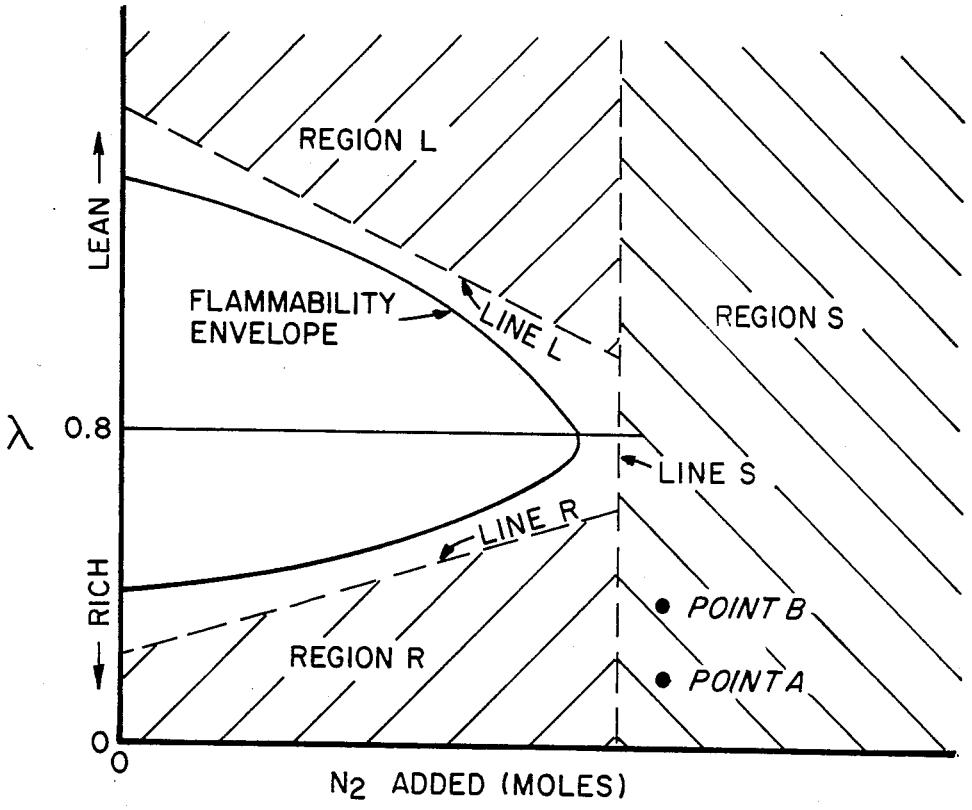
FIG. 2 is a flammability graph of λ versus nitrogen equivalent in a produced gas.

Flammability conditions can be ascertained for mixtures of fuels, air and inert gases by the determination or calculation of two parameters of the gas mixtures. First, the stoichiometric ratio for $\lambda$ is calculated, which is $\lambda=(0_2)/(0_2)_s$ where $(0_2)$ is the actual moles of oxygen in a given gas mixture and $(0_2)_s$ is the moles of oxygen which would be needed to stoichiometrically combust the fuel components in that gas mixture to $CO_2$, $H_2O$ and $SO_2$. If $\lambda$ is greater than 1.0, the mixture is lean (excess oxygen exists), and if it is less than 1.0, the mixture is rich (excess fuel exists). Second, the amount of inert gas in the original produced gas is calculated based upon nitrogen (nitrogen equivalent), which is added to the mixture comprising the fuel and air or oxygen. These two parameters, λ and added inert gas (or its nitrogen equivalent), define a flammable envelope for each of the fuel components typically found in produced gases. Such an envelope is shown in FIG. 2 at 25° C. and atmospheric pressure. For zero added inert gas, FIG. 2 reduces to the flammability limits for the fuel components in air. For a given fuel, a composition point within the envelope is flammable or even detonable, while outside the envelope, it is not flammable. Flammability envelopes change for given fuel components and also for varying temperatures and pressures. Therefore, the flammability envelope of FIG. 2 will expand and contract on the graph proportional to temperature and pressure as set forth in Limits of Flammability of Gases and Vapors, Coward, H. F. and Jones, G. W., U.S. Bureau of Mines, Bulletin 503, 1952. The distillation distribution of the co-produced petroleum is also important to ascertaining flammability because it allows the determination of the types of flammable gases and vapors that will exist at the bottom of the production well, as well as the volatility of compounds other than components existing in the gas phase at the production well head.

The following discussion is an example of the method for estimating the volatiles that should be in the down hole vapors (down hole is used herein in reference to the top of the liquid column in the well). A crude oil has a distillation curve that permits one skilled in the art to calculate the approximate volume percentages of hydrocarbons in the oil to be:

$C_5$—0.47%
$C_6$—0.94%
$C_7$—1.41%
$C_8$—2.40%
$C_9$—3.30%
$C_{10}$—2.98%
$C_{11}$—3.62% plus heavier components. The down hole temperature is 149° C. and the down hole pressure is estimated to be 300 psia.

Thermodynamic principles may be used by one skilled in the art to calculate the approximate mole percentage of each of the above hydrocarbon species in the vapor in the down hole well conditions of the components present in the crude oil. For example, considering only the species $C_5$, if Raoult's Law (see Introduction to Chemical Engineering Thermodynamics, 3rd Ed., 1975 McGraw-Hill, Smith and VanNess, p.298) is assumed, then the approximate mole percentage of $C_5$ vapor present at the down hole well conditions would be:

$$C_5 = 0.47 \times \frac{223}{300} = 0.35\%,$$

where 223 psia is the saturation pressure for $C_5$ or pentane at 149° C. Similar approximate mole percentages may be calculated for the other hydrocarbon vapors present in the well.

Using the mechanism set forth above for $C_5$, the components of the gas and vapor detected at the well head can be corrected for down hole vapor components by the following procedure. A produced gas at the top of a well is found from a gas chromatograph analysis to be, for example:

$O_2$—6.0 mole %
$CO_2$—7.4
$N_2$—79.7
CO—0.79
$CH_4$—4.8
$C_2H_6$—0.31
$C_3H_8$—0.77
$C_4H_{10}$—0.26

Combining the above estimated mole percentages of the hydrocarbon vapors with the above gas chromatograph analyses, the estimated mole percentages of the gases and vapors at the bottom of the well, at least through $C_{11}$, are determined to be as follows based upon the mechanism set forth for $C_5$ above.

$O_2$—5.9 mole %
$CO_2$—7.3
$N_2$—78.9
CO—0.78
$C_1$—4.8
$C_2$—0.31
$C_3$—0.76
$C_4$—0.26
$C_5$—0.35
$C_6$—0.33
$C_7$—0.24
$C_8$—0.22
$C_9$—0.15
$C_{10}$—0.07
$C_{11}$—0.05

This estimated in-situ combustion gas/vapor composition at the down hole well location generally lies at point A of the graph of FIG. 2 and shows its relative relation to the flammability envelope set forth in that graph wherein λ is plotted against added inert gas (nitrogen equivalent). This point for the gas composition mixture identified above is calculated in the following manner. Based upon the fuel gas components and oxygen present in the above-listed mixture, λ is calculated to be 0.18. The effect of carbon dioxide is converted to equivalent nitrogen by the ratio of the specific heats to yield 11.0 moles of nitrogen and the amount of nitrogen that would be associated with the oxygen present as air was calculated as 22.18. The amount of added inert gas (nitrogen equivalent) is then adjusted to $78.9+11.0-22.16=67.7$ moles. Such a point A is shown in the graph of FIG. 2 lying in region S wherein it would be outside the flammability envelope.

To emphasize the importance of correcting the gas chromatograph analyses obtained at the top of the well for the temperature and pressure of the liquid crude oil at the bottom of the well, and hence its vapors, the λ and added inert gas (nitrogen equivalent) coordinates may also be calculated for the original gas chromatograph analysis. The results are $\lambda=0.36$ and diluent nitrogen gas $=68.3$ which generally lies at point B of the graph of FIG. 2. A practice of utilizing only the gas chromatograph analyses for the prediction of the flammability of the produced gases can introduce a significant error as may be noted in this example.

The flammability envelope shown in FIG. 2 will now be described with regard to the graph of λ calculations versus moles of added inert gas (nitrogen equivalent). Regions L, S and R are deemed to be safe regions where no flammability and detonation is possible. Region S is the most preferred range, while Region R is less preferred, and Region L is least preferred, but it is still safe. One region in which it is unsafe to operate an in-situ combustion enhanced recovery production well constitute the area of the graph under line L and above the horizontal λ line 0.8, bounded by the ordinate and line S. A second region of potential flammability and detonation exists above line R and below λ line 0.8 and bounded by the ordinate axis and the line S. Different control actions are taken for the upper flammability zone in contrast to the lower flammability zone. The area between the flammability envelope and the edges of the three regions L, S and R represents a safety factor which is included in the computations for predicting control requirements. The magnitude of this safety factor can be chosen to be of any magnitude, but should be such that the minimum distance from the flammability envelope to any boundary of regions L, S or R is equivalent to at least 5 moles of added inert gas (nitrogen equivalent). Line L, R and S are established, preferably with the following safety factors:

(a) If the carbon monoxide content of the produced gas is less than 0.2 volume percent of the gas mixture produced, then line S is a vertical line at a value of 49 moles of added inert gas (nitrogen equivalent), line L is a staight line described by the equation $\lambda=-0.02\ (N_2)+1.2$ and line R is a straight line described by the equation $\lambda=0.007\ (N_2)+0.1$.

(b) If the carbon monoxide of the previous gas is greater than 0.2 volume percent then line S is a vertical line at a value of 63 moles added inert gas (nitrogen equivalent), line L is described by the equation $\lambda=0.033\ (N_2)+4.2$ and line R is described by the equation $\lambda=0.013\ (N_2)-0.75$. Because carbon monoxide generally presents the largest flammability envelope and, therefore, would be graphed per FIG. 2 with the largest flammability envelope area, the conditions for flammability prediction are determined by the ascertainment of the total fuel coordinates, including carbon monoxide values, which would provide a safe margin of error.

The operation of the apparatus of FIG. 1 will now be described with reference to the ascertainment of conditions in FIG. 2. The periodic sampling of produced gas is analyzed by the gas analyzer for compositional traits and then fed to the control system which is also monitoring flow rate temperature and pressure and, less frequently, oil distillation distribution. By comparing the gas analysis adjusted for such conditions against pre-existing flammability specifications identified in FIG. 2 as flammability envelope, the control system comprising a digital computer can give appropriate output necessary to affect continual operation with or without the addition of moderant gas. If the control system determines that the gas composition is in regions S, L or R, no action is taken by the control system. If the gas composition point falls in the area bounded by lines R, S and $\lambda=0.8$, the composition is deemed to be potentially flammable and detonable, and the control system will respond in one of four modes depending on pre-programmed choices and availability of specific injected moderant gases. The control system identifies the flow rate of the produced gas in order to determine the flow rate of moderant gas needed to appropriately adjust the flammability condition of the produced gas. Using the pressure sensed in the pressure assembly 78 of FIG. 1, the control system can also set the pressure of any one of the moderants to be added to the production well. The flow of the moderant is adjusted to the flow of the produced gas to provide the desired beneficial safety effect. In this region, the preferred moderant would be an inert gas which would reduce the flammability condition using nitrogen, carbon dioxide or an inert combustion product or argon. Alternatively, a fuel gas such as methane or natural gas can be added to further enrich the already rich combustible gas to place the composition in a range where it is too rich for flammability or detonation at stated conditions.

If the gas composition in the produced gas from the production well is determined to be in the flammability envelope bounded by line S, line L and $\lambda=0.8$, a flammability and detonation potential exists and moderant addition using nitrogen, carbon dioxide, inert combustion gas or argon, should be instituted to bring the composition outside of the flammability envelope into region L or S. Air can also be added which will remove the composition into region L, although this is not a preferred mode of operation. Fuel would not be added to a composition in this region because it would initially move the mixture even deeper into the flammable region.

The present invention is a unique solution to the problems of operating an in-situ air or oxygen combustion oil and gas production project because it allows continued, controlled, safe operation of such an in-situ combustion, wherein carbon monoxide, hydrocarbons and various oxidant gases may exist in the produced gas. Previous modes of operating an in-situ combustion required the shut-down of individual wells of the project or the continued operation of the project in an unsafe, potentially flammable or detonable condition. The present invention allows continuous safe operation wherein flammable conditions may exist, but are moderated and adjusted so that continuous production of the petroleum reserve is preserved, while safe conditions may be brought into existence at the production well site.

The invention is defined by the claims which follow.

We claim:

1. In a process for producing oil and gas from a production well in an oil-bearing formation using in-situ combustion of a portion of the oil with an oxidant gas, the improvement for controlling the flammability of the gas co-produced with the oil, comprising:

(a) sampling the produced oil from said production well and determining its distillation characteristics;

(b) periodically sampling the produced gas from said production well;

(c) sensing the temperature and pressure of the production well and sensing the flow rate of the produced gas;

(d) processing the sampled production gas through a gas analyzer to determine its gas composition;

(e) comparing the output of step (d) adjusted for the conditions of step (a) and (c) against pre-existing gas composition specifications for flammability wherein the comparison includes the determination of the flammability value $\lambda=(0_2)/(0_2)_s$ in which $(0_2)$ is the measured oxygen content of the produced gas in moles and $(0_2)_s$ is the oxygen content in moles which are required to stoichiometrically combust the fuel components in the mixture and the determination of the amount of inert gas (nitrogen equivalent) in the mixture and injecting a moderant gas into the production well adjacent the oil bearing formation when the composition of step (d) exceeds the pre-existing gas composition specifications for flammability, said injection continuing until the sampled production gas is outside the range of gas composition specifications for flammability.

2. The process of claim 1 wherein the moderant gas is selected from the group consisting of nitrogen, carbon dioxide, argon, steam, natural gas, methane, fuel gas, combustion product gas or air.

3. The process of claim 1 wherein the addition of moderant gas is proportional to the extent of flammability of the produced gas.

4. In an apparatus for producing oil and gas from a production well in an oil-bearing formation using in-situ combustion of a portion of the oil with an oxidant gas, the improvement for controlling the flammability of the gas co-produced with the oil, comprising:

(a) means for sampling the produced oil from said production well and determining its distillation characteristics;

(b) means for sampling the produced gas from said production well;

(c) temperature and pressure sensing means associated with the oil-bearing formation adjacent the production well and a flow rate sensing means for determining the flow of produced gas;

(d) a gas analyzer for determining the composition of the sampled gas;

(e) means for introducing a moderant gas into the production well adjacent the oil-bearing formation including a tubular and an operatively associated valve for injecting said moderant gas;

(f) computation means for receiving the output of components (a), (b), (c) and (d) and comparing those values against pre-existing gas composition specifications for flammability, and (g) means for opening the valve of paragraph (e) responsive to a signal from the computation means (f) when the computed value exceeds the pre-existing gas composition specifications for flammability.

* * * * *